United States Patent [19]

McConnell et al.

[11] 4,072,392

[45] Feb. 7, 1978

[54] SPRING WIRE FORMED TULIP CONTACT

[75] Inventors: Lorne D. McConnell, Chalfont; Leonard J. Kucharski, Harleysville, both of Pa.

[73] Assignee: Gould Inc., Rolling Meadows, Ill.

[21] Appl. No.: 725,378

[22] Filed: Sept. 22, 1976

[51] Int. Cl.[2] ..... H01R 13/12

[52] U.S. Cl. ..... 339/258 R; 339/262 R

[58] Field of Search ..... 339/255, 256, 258, 259, 339/262

[56] References Cited

U.S. PATENT DOCUMENTS

| | | | |
|---|---|---|---|
| 3,805,220 | 4/1974 | Silbermann | 339/258 R |

FOREIGN PATENT DOCUMENTS

| | | | |
|---|---|---|---|
| 1,404,644 | 5/1965 | France | 339/256 R |
| 1,041,559 | 10/1958 | Germany | 339/259 R |

*Primary Examiner*—Joseph H. McGlynn

*Attorney, Agent, or Firm*—Ostrolenk, Faber, Gerb & Soffen

[57] ABSTRACT

A spring wire formed tulip contact comprises cylindrical male and female members. The female member is formed by placing a plurality of spring wire fingers around the outer circumference of a cylindrical stud member in such a manner that the plurality of fingers extend axially outward from the stud to form a female contact sleeve. Each of the plurality of fingers are bent axially inward with respect to the stud in order that the innermost diameter of the female contact sleeve is smaller than the outer diameter of the male contact member. The plurality of fingers are held in firm electrical and mechanical contact with the stud member by a cylindrical retaining ring.

9 Claims, 9 Drawing Figures

FIG. 6.
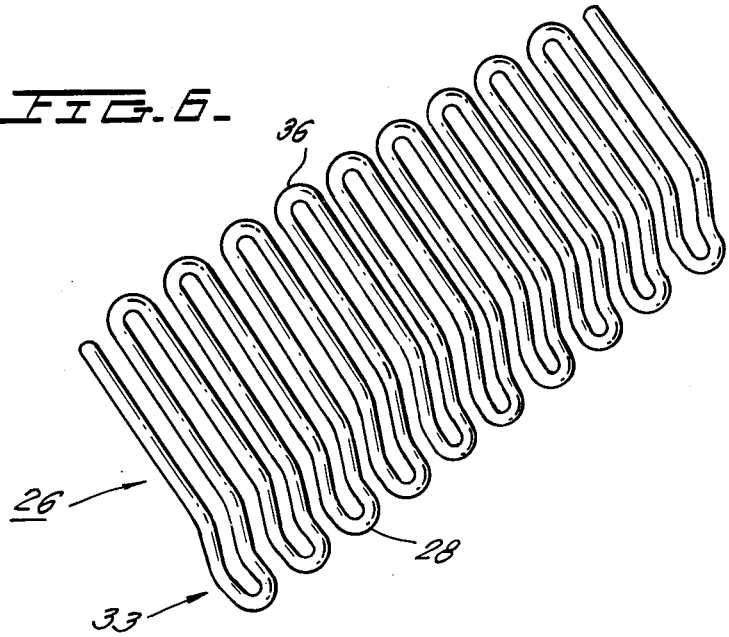
FIG. 7.
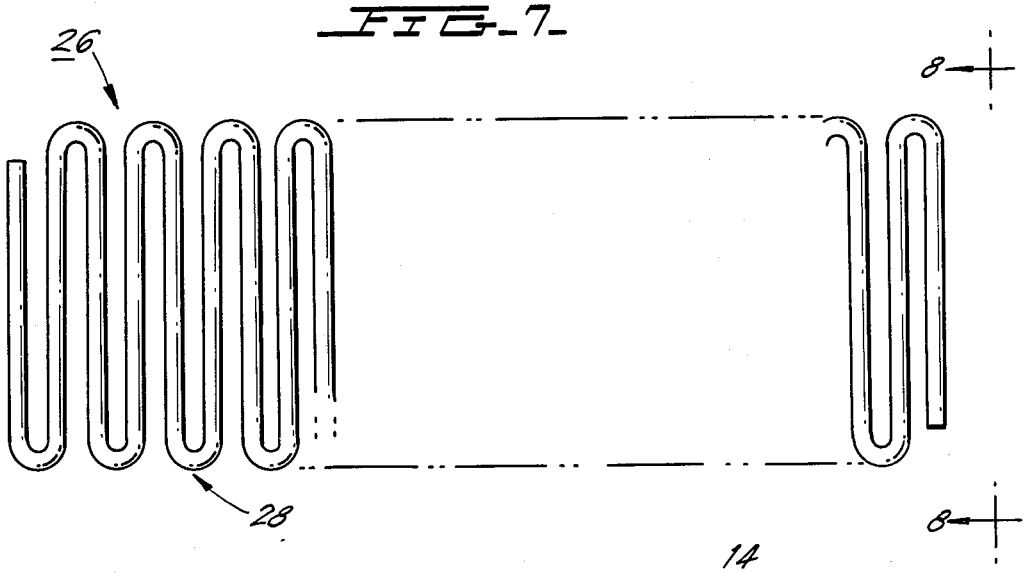
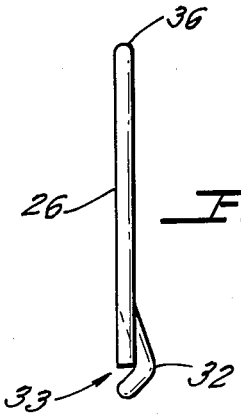
FIG. 8.
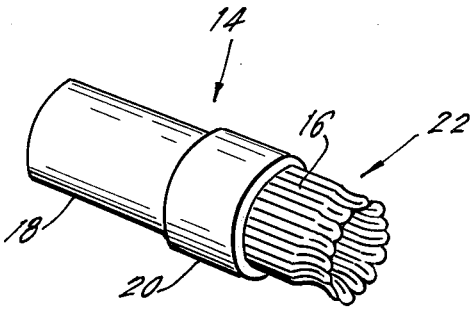
FIG. 9.

SPRING WIRE FORMED TULIP CONTACT

BACKGROUND OF THE INVENTION

Tulip clips are often used in high power electrical apparatus such as circuit breakers having current ratings in excess of 2,000 amperes. Ohmic losses in such apparatus, attributable to contact resistance between the fingers of the tulip clips and the conductor engaged in the tulip clip, can be quite significant and are highly undesirable. In an effort to restrict these losses to acceptable levels, prior art tulip clips have been designed to maximize the surface contact between the conductor engaged by the tulip clip and the fingers of the tulip clip itself. The standard procedure for maximizing surface contact between these elements has been to bend or mill the fingers of the clip to form a circumferential arc in the clip which conforms to the surface of the conductive element engaged thereby. Tulip clips of the foregoing type are disclosed in U.S. Pat. Nos. 3,806,768 and 3,909,571.

While the foregoing structure has satisfactorily reduced ohmic losses to acceptable levels, it has necessitated a separate machining operation to form the desired circumferential bend. Such operations are costly and result in waste of material.

BRIEF DESCRIPTION OF THE INVENTION

The present invention overcomes the foregoing deficiencies by utilizing a plurality of cylindrical spring wire fingers each having a high contact resistance with respect to the conductive elements engaged by the tulip clip but collectively exhibiting an overall low effective contact resistance and low ohmic losses. That is, while the contact resistance of each wire finger is relatively high, each of the wire fingers is connected in parallel with the remaining wire fingers thereby collectively presenting a low effective contact resistance.

In the first embodiment, a plurality of individual spring wire fingers, each circular in cross-section, extend axially from a cylindrical stud member to form a female contact sleeve. The spring wire fingers are retained in spaced parallel relationship around the periphery of stud member by a cylindrical retaining ring which may be heat shrunk around the fingers to provide a high pressure contact between the fingers and the stud member. Such an arrangement assures good electrical contact between the fingers and stud members and maintains the proper orientation of the fingers.

In a preferred embodiment, the ends of each finger are provided with a semicircular bend which defines a contact point at which the finger contacts the male contact member when the male and female contact member are mated. The bend in each finger faces inwardly towards the central axis of the stud member such that the innermost portion of each bend cooperates with the innermost portion of the remaining bends to form a contact ring. Significantly, the diameter of the contact ring (which defines the innermost diameter of the female contact sleeve) is smaller than the outer diameter of the male contact member so that the fingers may be biased against the male contact member when the male contact member is placed in operational engagement with the female contact member.

In a second embodiment of the present invention, the plurality of spring wire fingers are part of a single continuous wire which has been bent to the desired form. While this embodiment is substantially similar to the foregoing embodiment, it reduces the number of parts to be handled and provides a smoother outer end free of sharp edges which may be presented by the individual fingers of the first embodiment.

The foregoing embodiments of the present invention represent a significant advance over the prior art. Initially, the contact can be simply and inexpensively manufactured using inexpensive, readily available components which need not meet high tolerance specifications. Additionally, each wire finger may be identically formed permitting interchangeability and a further reduction in the cost of manufacture.

One of the most significant aspects of the present invention is that it employs inexpensive spring wire which is readily commercially available in reliable forms exhibiting consistent physical properities and freedom from defects. While the individual wire fingers may be formed into the desired shape by any desired process, it is possible to produce them using a one-step automated form and cut-off machine.

Other advantages of the present invention will become apparent through a reading of the detailed description of the preferred embodiment set forth below.

BRIEF DESCRIPTION OF THE DRAWINGS

For the purpose of illustrating the invention, there is shown in the drawings a form which is presently preferred; as being understood, however, this invention is not limited to the precise arrangements and instrumentality shown.

FIG. 6 is a perspective view of the spring wire fingers used in a second embodiment of the present invention.

FIG. 7 is a front plan view of the fingers of FIG. 6.

FIG. 8 is a side plan view of the fingers of FIG. 6.

FIG. 9 is a perspective view of a second embodiment of the female contact member of the present invention.

DETAIL DESCRIPTION OF THE PREFERRED EMBODIMENT

Figure 1:
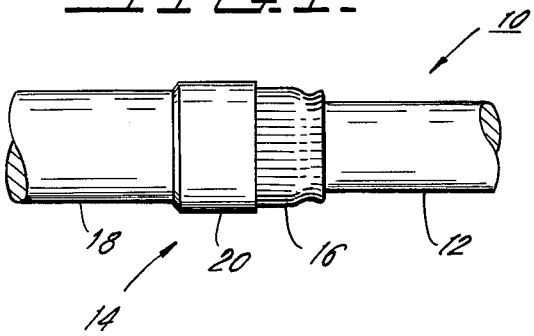
FIG. 1 is a side plan view of a spring wire formed tulip contact constructed in accordance with the present invention.
Figure 2:
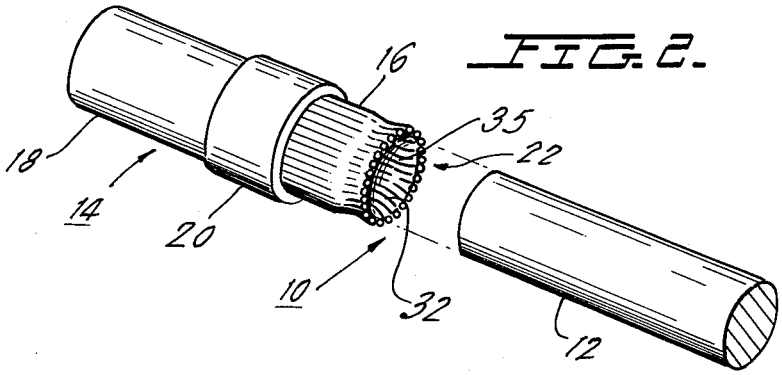
FIG. 2 is a perspective view of the contact of the present invention before the male and female portions are mated.

Referring now to the drawings wherein like numerals indicate like elements there is shown in FIGS. 1 and 2 a spring wire tulip contact constructed in accordance with the principles of the present invention and designated generally as contact 10.

Contact 10 comprises male contact 12 and female contact 14. Female contact 14 includes a plurality of individual copper wire fingers 16 secured to the periphery of copper stud 18 by retaining ring 20. Fingers 16 are circular in cross-section and may be formed of any conductive material exhibiting good electrical and spring type characteristics. It is preferable that chrome copper or other material exhibiting low surface oxidation characteristics be used.

As best seen in FIG. 2, individual wire fingers 16 form a circular sleeve adapted to engage male contact 12. When referred to cumulatively, individual wire fingers 16 will be referred to as female contact sleeve 22.

Figure 3:
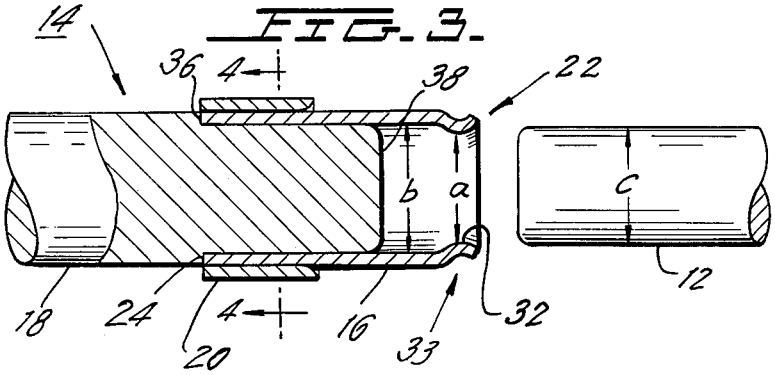
FIG. 3 is a side plan view, partially in cross-section, of the male and female contact members of the present invention before the male and female portions are mated.
Figure 5:
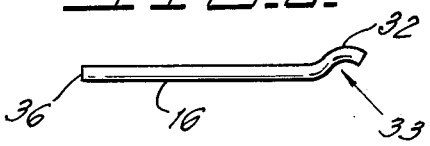
FIG. 5 is a side plan view of a spring wire finger.

As best seen in FIGS. 3 and 5, the tip of each finger 16 is provided with a semicircular bend 33 which is adapted to engage male contact 12. As best seen in FIGS. 2 and 3, fingers 16 are positioned with their innermost portion or contact points 32 facing the central axis of female contact sleeve 22 such that the contact points 32 cumulatively form a contact ring 35 adapted to engage male contact member 12 when female member 14 and male contact member 12 are mated. Significantly, the diameter "*a*" of the contact ring 35 (which defines the innermost diameter of contact sleeve 22) is less than the outer diameter "*c*" of male contact 12. This provides a high pressure contact between fingers 16 and male contact 12 when male contact 12 and female contact 14 are mated thereby assuring good electrical contact between the two contact members.

By way of example and not limitation, wire 16 may have a length of about 2 inches and a diameter of $\frac{1}{4}$ inches. A $\frac{1}{4}$ inch radius bend 33 may be formed in the end of fingers 16 such that the innermost diameter "*a*" of female contact sleeve 22 is $\frac{1}{4}$ inch less than the diameter "*b*" of female contact sleeve 22. Diameter "*b*" may be typically about 2 inches. While the particular diameter "*a*" of contact ring 35 is not significant, it must be sufficiently smaller than the diameter "*c*" of male contact 12 in order that the individual wire fingers 16 are biased a sufficient amount to provide good electrical contact with male contact 12 when male contact 12 and female contact 14 are mated as shown in FIG. 1.

It is desirable that the contact points 32 on each finger 16 extend axially an equal distance from end 38 of stud 18 in order that contact ring 35 lie on a plane perpendicular to the central axis of contact sleeve 22. The proper positioning of contact points 32 is assured by a step 24 in stud 18. The rearmost portion 36 of fingers 16 is placed against step 24 thereby positioning each contact point 32 an equal distance from the end 38 of stud 18.

Figure 4:
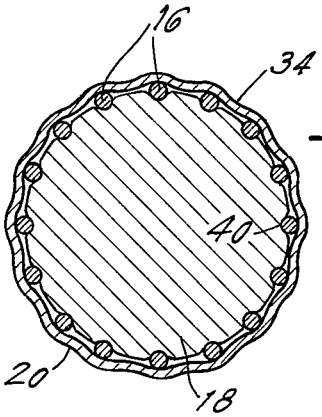
FIG. 4 is an enlarged cross-sectional view of the female contact member taken along lines 4—4 of FIG. 3.

It is extremely important that fingers 16 be maintained in high pressure contact with stud 18 to assure good electrical contact between fingers 16 and stud 18 as well as to assure the proper orientation of fingers 16. For this reason, a pressure ring 20 has an effective diameter less than the diameter of a circle defined by the outermost edges of fingers 16 as they are arranged around stud 18 as shown in FIG. 4. It is preferred that ring 20 is heat shrunk around fingers 16 in order that the ring be deformed at points 34 between fingers 16. Retaining ring 20 may also be deformed by hydraulic, explosive or other electrodynamic forming tool to firmly bias fingers 16 against stud 18.

As further shown in FIG. 4, stud 18 may be provided with longitudinally extending grooves 40 which seat fingers 16. Grooves 40 aid in the positioning of fingers 16 and assure the proper parallel spacing thereof.

In the foregoing description of the present invention, female contact sleeve 22 comprises a plurality of individual identical wire fingers 16 of circular cross-section. In a second embodiment of the present invention, female contact sleeve 22 is formed from a single continuous wire 26 which is bent into the proper shape on a wire or spring-forming machine. An appropriately shaped wire 26 is illustrated in FIGS. 6, 7 and 8. A pair of axially extending portions of wire 26 form a single finger 28. As with the embodiment described above, the ends of each finger pair 28 include a semicircular bend 33 to form a contact point 32 adapted to engage male contact 12. To form contact sleeve 22, it is only necessary to cut off an appropriate length of wire 26 and wind it circumferentially around stud 18 in the manner illustrated in FIG. 9. As shown therein, fingers 28 are biased against stud 18 by retaining ring 20 and extend axially from stud 18 to form a female contact sleeve 22.

The embodiment of the invention shown in FIGS. 6–9 reduces the number of parts to be handled and provides a smoother outer end free of sharp edges which may be presented by the individual fingers 16 in the embodiment shown in FIGS. 1–5. This is especially advantageous when the fingers 28 are subjected to very high electrical stress in the contact open position.

The present invention may be embodied in other specific forms without departing from the spirit or essential attributes thereof and, accordingly, reference should be made to the appended claims, rather than to the foregoing specification as indicating the scope of the invention.

What is claimed is:

1. A female contact member adapted to engage a male contact member, comprising:

a conductive stud member;

a plurality of spring wire fingers having a circular cross-section, said fingers located adjacent the periphery of said stud member and extending from said stud member to form a female contact sleeve;

means for retaining said fingers in said position adjacent the periphery of and extending from said stud member and for retaining said fingers in good electric contact with said stud member, the periphery of said stud member having a plurality of parallel, longitudinally extending grooves therein, each of said wire fingers being seated in respective ones of said longitudinally extending grooves in the periphery of said stud member.

2. A female contact member as claimed in claim 1 wherein each of said plurality of wire fingers is separate and independent from the remaining said wire fingers and wherein said plurality of wire fingers are identical to one another and are cut from a single length of conductive spring wire.

3. A female contact member as claimed in claim 1 wherein said plurality of wire fingers are part of a single continuous wire.

4. A female contact member as claimed in claim 1 including a step in said stud member against which the proximal end of said fingers rest.

5. A female contact member as claimed in claim 1 wherein said fingers are formed of chrome copper wire.

6. A female contact member as claimed in claim 1 wherein said means for retaining said fingers in said position adjacent the periphery of and extending from said stud member comprises a retaining ring biasing said fingers against said stud member.

7. A female contact member as claimed in claim 1 wherein said wire fingers are bent inwardly towards the central axis of said female contact sleeve and wherein the distal ends of said wire fingers are bent outwardly away from the central axis of said female contact sleeve.

8. A female contact member as claimed in claim 7 wherein the innermost diameter of said female contact sleeve is smaller than the outer diameter of the male contact member said female contact member is adapted to engage.

9. A spring wire formed tulip contact including a generally cylindrical male contact member and a generally cylindrical female contact member; said female contact member comprising:

a generally cylindrical stud member;

a plurality of cylindrical spring wire fingers located adjacent to the periphery of said stud member and extending axially from the said stud member to form a female contact sleeve; said wire fingers being bent radially inward toward the central axis of said female contact sleeve such that the innermost radius of said female contact sleeve is smaller than the outer radius of said male contact member;

means for retaining said fingers in said position adjacent to the periphery of and extending from said stud member and for retaining said fingers in good electrical contact with said stud member; said plurality of wire fingers being part of a single continuous wire, the free end of said fingers being free to flex outwardly without any restraint other than their inherent spring characteristic;

the periphery of said stud member having a plurality of parallel, longitudinally extending grooves therein, each of said wire fingers being seated in respective ones of said longitudinally extending grooves in the periphery of said stud member.

* * * * *